United States Patent [19]

Adams, Jr. et al.

[11] Patent Number: 4,743,943

[45] Date of Patent: May 10, 1988

[54] RENEWABLE FUSER WICK

[75] Inventors: Lawrence Adams, Jr., Longmont; Reid W. Gunnell, Berthoud, both of Colo.

[73] Assignee: International Business Machines Corporation, Armonk, N.Y.

[21] Appl. No.: 2,543

[22] Filed: Jan. 12, 1987

[51] Int. Cl.[4] ..... G03G 15/20

[52] U.S. Cl. ..... 355/3 FU; 118/260; 118/101; 355/10; 355/14 FU; 432/60

[58] Field of Search ..... 118/60, 70, 260, 261, 118/264, 268, 269, 652; 432/59, 60; 355/3 FU, 15, 14 FU, 3 R, 10; 219/216; 15/256.51, 209 R, 223; 101/425

[56] References Cited

U.S. PATENT DOCUMENTS

| | | | |
|---|---|---|---|
| 1,852,114 | 4/1932 | Green | 15/209 R |
| 3,718,116 | 2/1973 | Thettu | 118/264 X |
| 3,745,972 | 7/1973 | Thettu | 118/261 |
| 3,831,553 | 8/1974 | Thettu | 118/264 X |
| 3,841,827 | 10/1974 | Thettu | 118/260 X |
| 3,859,957 | 1/1975 | Larson | 118/70 |
| 3,884,181 | 5/1975 | Thettu | 118/261 |
| 3,908,589 | 9/1975 | Bar-on | 118/261 X |
| 4,083,322 | 4/1978 | Beckman, Jr. | 118/70 |
| 4,145,181 | 3/1979 | Edwards et al. | 432/60 |
| 4,154,575 | 5/1979 | Edwards et al. | 432/60 |
| 4,277,161 | 7/1981 | Calabrese | 219/216 X |
| 4,309,957 | 1/1982 | Swift | 118/60 |
| 4,336,766 | 6/1982 | Maher et al. | 118/60 |
| 4,378,752 | 4/1983 | Knechtel | 118/70 X |
| 4,407,219 | 10/1983 | Dellevoet | 118/60 |

FOREIGN PATENT DOCUMENTS

| | | | |
|---|---|---|---|
| 0165719 | 12/1985 | European Pat. Off. . | |
| 0002177 | 1/1986 | Japan | 355/3 FU |

OTHER PUBLICATIONS

Anonymous Disclosure, "Apparatus for Applying a Fluid to a Roller Surface with a Wick," Research Disclosure, No. 136, 8/75-pp. 23-24.

Rengert, "Oil Metering Blade Holding Device," Xerox Disclosre Journal, vol. 1, No. 8, 8/76-p. 23.

*Primary Examiner*—R. L. Moses

*Assistant Examiner*—John G. Smith

*Attorney, Agent, or Firm*—Francis A. Sirr

[57] ABSTRACT

An electrophotographic reproduction device includes a pressure roll fuser whereat toner carried by a sheet of paper is fused onto the paper's surface by the application of both heat and pressure as the sheet passes through a pressure fusing nip. The pressure nip is formed by pressure engagement of a heated fusing roll to an unheated backup roll. A multilayer cloth wick rubs against a portion of the hot roll's toner engaging surface, and thereby supplies release oil to this surface. When the wick's outer cloth layer becomes contaminated with toner and the like, the operator acitvates a manually releasable stitch which is associated with the wick's multiple layers. This action allows manual removal of the wick's top contaminated layer, thereby exposing a clean cloth surface for subsequent engagement to the hot roll's toner engaging surface.

33 Claims, 4 Drawing Sheets

RENEWABLE FUSER WICK

DESCRIPTION

1. Field of the Invention

This invention relates to electrophotography, and to the electrophotographic process step of pressure fusing a toner image onto the surface of a substrate medium, as the medium passes through a pressure nip. Toner release material is applied to a roll means which forms the pressure nip.

2. Background of the Invention

Electrophotographic reproduction involves a number of well known process steps by which a colored toner image is permanently fixed to the surface of a thin substrate medium. For example, black toner is fixed to a sheet of white bond paper. The toner image, which may be formed by either a copier or a printer electrophotographic process, must be fused to the surface of the paper sheet in order to form a permanent toner image thereon.

A well known method of fusing comprises passing the paper sheet through a pressure nip that is formed by a pair of circular cylinder rolls or rollers. When this pressure nip does not include the application of heat, the device is called a cold pressure fuser. When the pressure nip includes application of heat to the toner image, the device is called a hot pressure fuser.

Two general types of hot roll fusers exist. One type includes the application of a release material, usually a type of silicone oil, to at least the roll that directly engages the toner. This toner engaging roll is usually the heated roll of the roll pair. The second type of hot roll fuser is characterized as a dry release fuser in that release material is not applied to either roll.

In either cold or hot pressure fusing, the construction and arrangement of the fuser must be such that the sheet of paper reliably releases from the surface of the rolls, as the sheet's leading edge exits the fusing nip. To aid in this release function, means such as air jets and mechanical stripper fingers have been provided to aid in disengaging the sheet's leading edge from the roll surface. The most critical roll is usually the toner engaging roll, since subjecting the toner to pressure, or both pressure and heat, in the fusing nip tends to cause the toner to adhere to this roll's surface.

As noted above, the application of a release material to the surface of at least the toner engaging roll aids in reliable release of the sheet's leading edge from this roll's surface as the sheet's leading edge exits the fusing nip. The prior art discloses a number of means by which release material may be applied to this roll's surface. One well known means is by the use of a cloth wick, of which U.S. Pat. Nos. 3,745,972; 3,884,181; 4,083,322; 4,309,957; 4,407,219 and European Patent Application No. 0 165 719 are examples.

A maintenance problem is associated with the use of a cloth wick. After many fusing operations, the wick's outer cloth surface becomes contaminated with toner and the like, as contaminates are gradually picked up off the roll's surface, since, indeed, one of the functions of the wick is to clean the roll's fusing surface. In addition, the wick's outer layer may become relatively impervious after many fusing operations as a result of gelation of the silicone oil itself. These effects reduce the ability of the wick to supply the release material to the roll surface, and paper jams begin to occur. These effects are generally predictable, and therefore a maintenance schedule is usually established to insure that the wick is replaced by highly trained maintenance personnel at regular intervals, as measured by use of the reproduction device.

This wick replacement procedure requires a trained service individual, usually not constantly present at the location of the reproduction device. Thus, the replacement procedure is both time consuming and expensive.

SUMMARY OF THE INVENTION

An object of the present invention is to provide a fuser wick construction and arrangement which enables the relatively unskilled operator of a reproduction device to renew the surface of the wick of an electrophotographic pressure fuser.

A first embodiment of the present invention accomplishes this objective by providing a multilayer fuser wick. The layers of this wick are held together by a manually releasable means. Actuation of this manually releasable means, by the operator, allows the operator to remove the top contaminated layer of the wick, leaving a clean underlayer to subsequently engage the toner engaging surface of the fuser roll. Only after a number of such manual operations have taken place is it necessary for the operator to call trained service personnel to replace the expended multilayer wick of the present invention with a new multilayer wick.

A second embodiment of the present invention provides a cut, carpet-like fabric mat that engages the roll surface. The cut fiber ends of the fabric penetrate one or more thin plastic cleaning sheets. When the ends of the fabric become contaminated, the top plastic sheet is removed. This operation scrubs the fibers and removes the contamination therefrom.

These and other features of the present invention will be apparent from the following description of preferred embodiments of the present invention.

THE INVENTION

The present invention is usable with a roll fuser of any of a number of well known constructions. However, the present invention is of special utility when it is used with a fuser having an operator removable toner engaging roll.

An exemplary fuser having such a removable roll is described in U.S. Pat. No. 4,145,181, incorporated herein by reference. A fuser of this general construction allows the operator to easily remove the toner engaging roll, thereby exposing the wick. The above-mentioned manually operable means of the present invention is now readily accessible to the operator. By this means, the operator removes the contaminated top layer of the wick, and then replaces the roll.

Figure 1:
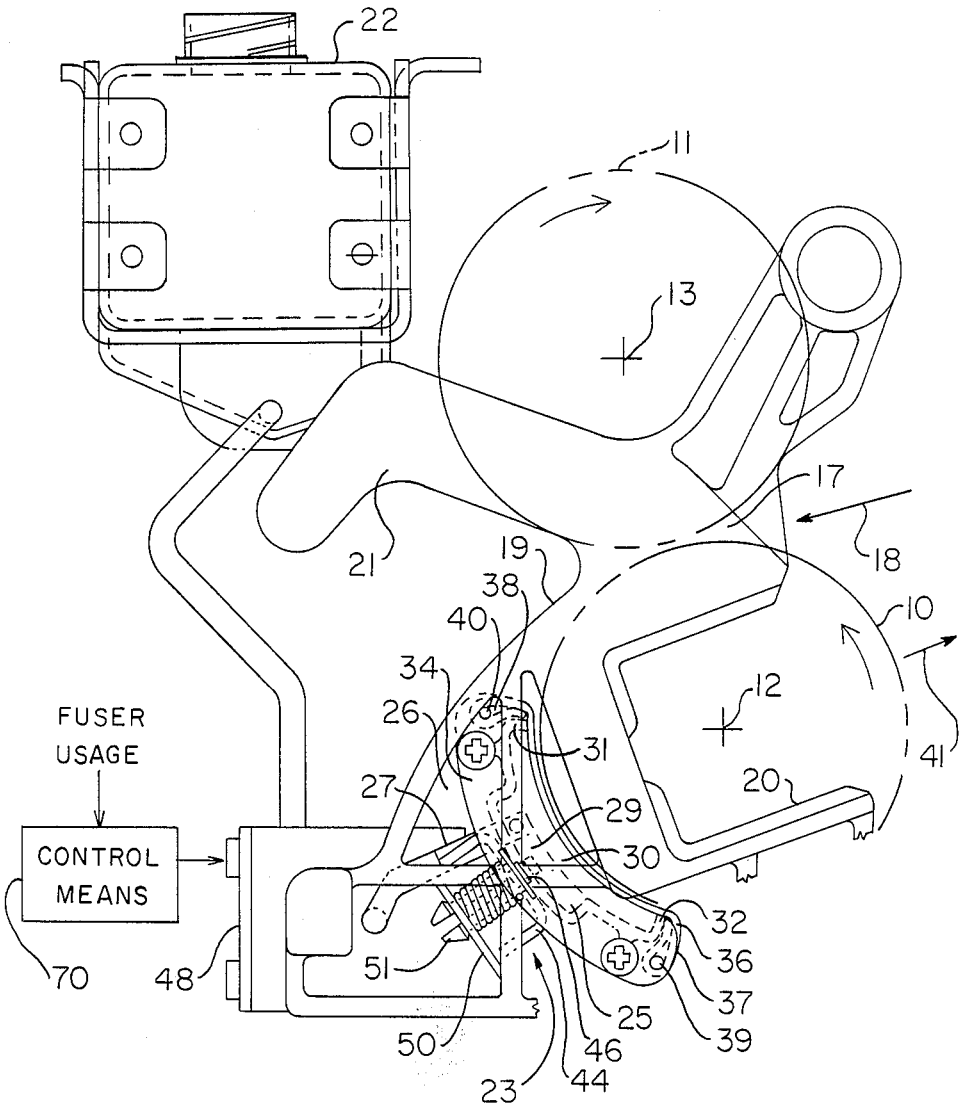
FIG. 1 is a side view of a two roll pressure fuser which includes the present invention.

FIG. 1 is a side view of a pressure fuser which includes the present invention. Only a portion of the fuser is shown, since details of the fuser's construction and arrangement are not critical to the present invention, and a number of suitable fusers are known to those skilled in the art.

The present invention is usable with any pressure roll fuser that provides for the application of a release material to one or both of the rolls. The showing of a particular fuser construction and arrangement herein is not to be taken as a limitation on the present invention.

The fuser assembly of FIG. 1 comprises a heated fusing roll 10 and an unheated backup roll 11. These circular cylinder rolls are driven to rotate about axes 12 and 13, respectively. In an exemplary reproduction device, where the paper passes through the device with its long edge (for example, the 11 inch edge or the 14 inch edge) as the leading edge, these rolls were about 16 inches long and about 3 inches in diameter.

Rolls 10 and 11 may, for example, be rolls 14 and 16 of the above-mentioned U.S. Patent.

A nip closing mechanism (not shown) is provided to close the rolls together, thereby forming an elongated fusing nip at 17. An exemplary nip closing mechanism is shown in U.S. Pat. No. 4,154,575, incorporated herein by reference. Paper passes through nip 17, carrying unfused toner on the underside thereof, while passing along a paper feed path exemplified by arrow 18.

As is well known to those of skill in the art, the surface of rolls 10 and 11 can take a number of forms. Hot roll fusers are known where both rolls include a metal core that is covered with a resilient elastomer, where both rolls are covered with a tetrafluoroethylene (TFE) material (of which Teflon is an exemplary brand), or where one roll is covered with an elastomer and the other roll is covered with a TFE material.

A flat metal support member 19 is provided at each end of the fuser assembly. Each of the support members 19 includes a U-shaped recess 20 that removably accepts an end block of hot roll 10, as is more fully described in U.S. Pat. No. 4,145,181. As will be apparent, this particular construction of member 19 is of special utility in relation to the present invention, but it is not mandatory.

An arm 21 of support members 19 holds an elongated container 22 of release material in the form of a silicone oil. As is well known by those skilled in the art, the type of release oil used depends on the type of surface contained on hot roll 10.

The lower portion of each support member 19 mounts a fuser wick assembly, identified generally in FIG. 1 by reference number 23. This wick assembly is best seen in the exploded view of FIG. 2.

With reference to that figure, the wick assembly includes an extruded metal channel member 24, about 16 inches long, having a shallow central recess 25. As seen in FIG. 1, the cross sectional, generally arcuate shape of channel member 24 (best seen in FIG. 2) matches the circular cross section of roll 10.

Recess 25 (FIG. 2) mounts a hollow metal tube 26. This tube has a central bore (not shown) that is closed at both ends. The mid portion of this bore is connected to an inlet tube 27 that extends through an opening 28 formed in the upper, mid portion of recess 25. The underside of tube 26 contains a series of small holes (not shown) by which release oil is supplied to cavity 25.

While release oil can be supplied to inlet tube 27 by way of a gravity feed system, it is preferred to control the feeding of oil from container 22 to tube 26 by the use of an electrically operated pump 48; see FIG. 1. A control means 70 is provided to operate the pump as a function of the number of sheets being fused and/or as a function of the toner density of the sheets being fused. In an exemplary arrangement, pump 48 was operated for ten seconds, every 50 fused sheets, to thereby deliver about 0.1 milliliter of oil to recess 25. Suitable piping connects the inlet of pump 48 to container 22 and the outlet to tube 27.

The oil supplied to recess 25 by tube 26 is absorbed by a lower cloth pad or strip 29 (FIG. 2), preferably made of aramid (an aromatic polyamide fiber, of which Nomex and Kevlar are exemplary brands). A larger upper pad 30, made of similar material, rests upon pad 29, and absorbs oil therefrom. Pad 30 is proportioned to occupy the rectangular space defined by the ends of member 24 and its two side walls 31 and 32.

A pair of metal end plates 33 and 34 are mounted to member 24 by means of screws, as shown.

Figure 3:
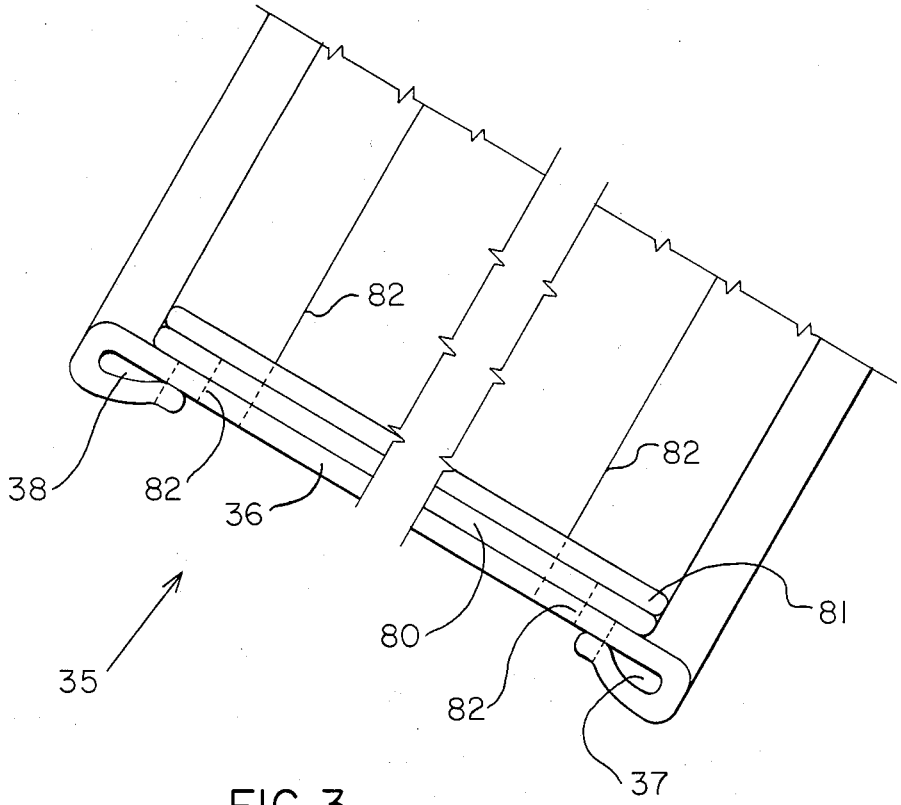
FIG. 3 is a partial end view of the clock wick which is contained in the wick assembly of FIG. 2.

Wick 35 is best shown in FIG. 3, wherein its multilayer construction and manually releasable stitching means are evident. Each layer of wick 35 is also preferably made of an aramid material.

Wick 35 (FIG. 3) includes a base cloth member 36 and at least one removable cloth member 80, 81. Base member 36 is sewn to form two side tubes 37 and 38. Side tubes 37 and 38 removably receive metal rods 39 and 40 (seen in FIG. 2), respectively. The opposite ends of rods 39 and 40 extend beyond the ends of wick 35, and provide a means whereby the wick is mounted to end plates 33 and 34, as the ends of rods 39 and 40 penetrate openings in the end plates which are provided for this purpose.

Rods 39 and 40 are of a uniform diameter, and include annular mounting recesses adjacent to each end thereof. These recesses are somewhat wider than the thickness of end plates 33 and 34. When the rods are in place on end plates 33 and 34, the tension of wick 35 snaps these rod recesses onto the end plates, and properly positions and holds the rods and the wick relative to the end plates.

When it is necessary to replace an expended wick, the rods are manually aligned with the openings in the end plates. The rods are then manually removed, thereby leaving the expended wick to be manually removed. To remount a new wick, the rods are inserted into the openings in one end plate, and into the side tubes 37 and 38 of the new wick. The rods are then inserted into the openings in the other end plate, and the rod recesses are again lined up with the plates so as to seat the rods thereon.

The width (i.e., the dimension measured in the direction of roll rotation) of wick 35 is selected such that when the end plates are mounted to channel member 25, causing the wick to wrap about side walls 31 and 32, the wick has enough slack to conform to the cylindrical surface of hot roll 10, as is seen in FIG. 1. In this condition, the underside of the wick's base layer engages the top of pad 30, and the wick is supplied with release oil.

When hot roll 10 is manually removed, by moving the roll in the direction of arrow 41 of FIG. 1, the wick is exposed so that the upper layer 80 or 81 thereof can be manually removed by the operator, to thereby expose a clean underlayer 80 or 36 for future engagement to the surface of the hot roll.

Figure 2:
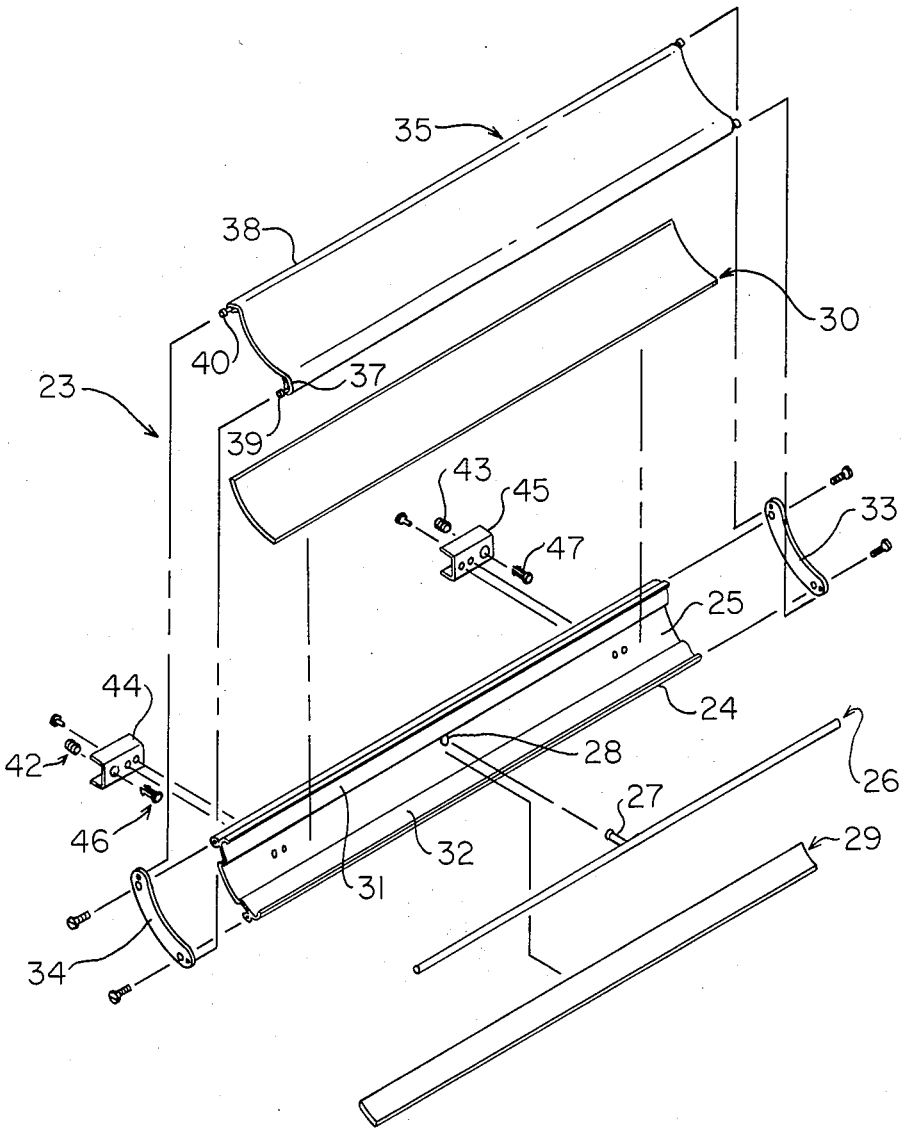
FIG. 2 is an exploded view of the wick assembly of FIG. 1.

The wick assembly of FIG. 2 is resiliently biased against the surface of hot roll 10 by means of two springs 42 and 43. The force with which the wick assembly was biased against the roll's surface in an exemplary arrangement was about 8.9 newtons. A pair of U-shaped metal brackets 44 and 45 are mounted to opposite ends of channel member 24 by screws, as shown. These brackets each carry a resilient plastic pin 46, 47 having a split end. Pins 46, 47 are the means by which the opposite ends of the wick assembly are mounted to the fuser's two support members 19.

With reference to FIG. 1, each of the support members 19 includes a metal tab 50 that extends generally perpendicular to the plane of members 19. Each tabs 50 includes an opening that receives the split end 51 of one of the pins 46, 47. When pins 46 and 47 are forced into the opening in a tab 50, coil springs 42 and 43 are compressed between the upper surface of its tab 50 and the underside of its metal bracket 44, 45. As the layers 80, 81 of wick 35 are manually removed, one by one, over an extended period of time, the thickness of the wick is reduced. However, springs 42 and 43 now expand, and thereby continue to hold the upper wick layer against the adjacent surface of heated roll 10.

When the operator has removed all of the upper wick layers, leaving only the bottom layer 36 as seen in FIG. 1, the operator schedules replacement of the multilayer wick at the next major maintenance interval for the reproduction device. In the meantime, the wick continues to supply release oil to roll 10 by operation of the wick's lowermost layer 36.

FIG. 3 shows a preferred multilayer wick for use in the present invention. In this preferred wick, the manually releasable means comprises a stitch of the type that is usually associated with manually openable cloth containers, where the manual pulling on two threads releases the stitch, and opens the container. In accordance with the present invention, such a stitch 82 is provided along the two longitudinal edges of each cloth layer, to thereby removably attach that layer to its adjacent underlayer.

The stitches associated with each individual layer of the wick contain coding, such as different colored threads and/or numbered tabs to which the threads are connected. This coding aids the operator in selecting the correct manually releasable means associated with the top wick layer.

While the use of this type of manually releasable stitch is preferred, the term manually releasable means as used herein is intended to encompass many equivalent means, such as, for example, manually releasable glues, adhesives or ultrasonic welding that are compatible with the wet release fusing process, or open staple-type thread stitches that penetrate all layers of the wick and allow manual removal of the top layer, as well as other equivalent means such as the use of the Velcro brand material, which are readily apparent to those skilled in the art.

Figure 4:
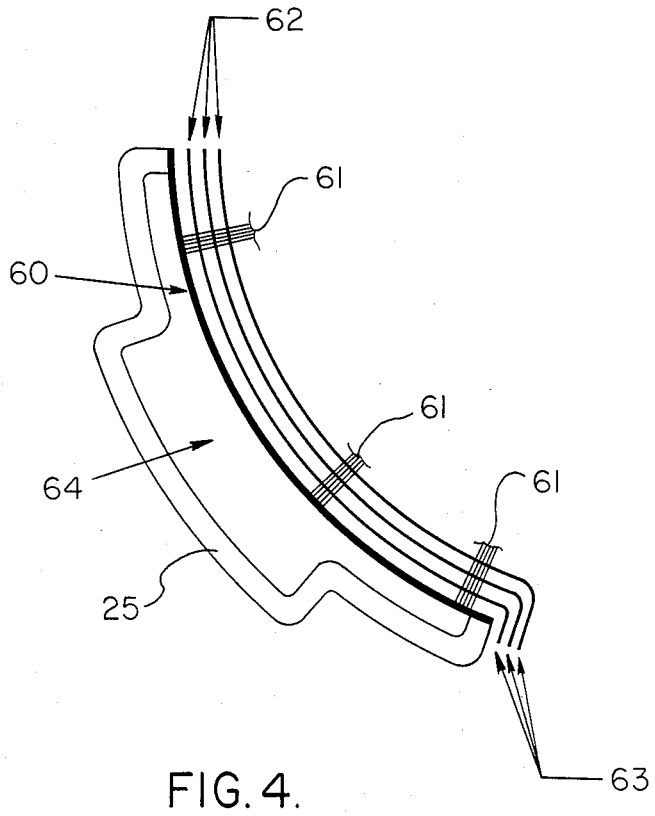
FIG. 4 is a showing of a second embodiment of a wick assembly in accordance with the present invention.

FIG. 4 shows another embodiment of a wick assembly in accordance with the present invention. This assembly includes a removable backing pad 60, preferably comprising an aramid material. A continuous mat of wicking fibers 61 (only some of which are shown) penetrate pad 60 and a number of layers of plastic cleaning material 62 which overlay each other. Material 62 is for example a thin, high temperature plastic material. The spacing of the various layers of material 62 to each other and to backing pad 60 is exaggerated in FIG. 4. In practice these layers lie closely adjacent each other.

In the making of the wick assembly of FIG. 4, pad 60 and the layers of material 62 are first placed together. Fibers 61 are now sewn through pad 60 and the layers of material 62, in much the same manner as a floor carpet is made. This process leaves loops of fiber 61 above the top layer 62. These loops are now cut, leaving a continuous mat surface of fibers 61, as shown.

Release oil is transferred from reservoir 64, through pad 60 to fibers 61. The ends of these fibers operate to transfer the oil to the roll surface. When the ends of fibers 61 become contaminated, tab 63 for the outer plastic layer 62 is manually pulled, to thereby remove the plastic layer. This pulling of the layer over fibers 61 operates to scrub and clean the exposed end portions of fibers 61. Tabs 63 include indicia, such as numbering to aid the operator in locating the top layer.

In an exemplary embodiment like FIG. 3 of the present invention, two removable wick layers were provided. Each layer was designed to operate for 250,000 fusing operations. The device logic displayed the need to remove a wick layer whenever this number of sheets had been fused. When the wick assembly reached 500,000 total sheets fused, the display additionally indicated the need for service personnel to replace the wick assembly at the occasion of the next service visit.

While this invention has been particularly shown and described with reference to preferred embodiments thereof, it will be understood by those skilled in the art that various changes in form and detail may be made therein without departing from the spirit and scope of this invention.

What is claimed is:

1. In a pressure fuser having a rotating roll which forms a pressure fusing nip to an adjacent member, wherein a toner image is fused to a substrate as the substrate passes through said fusing nip with the toner thereon engaging the surface of said roll, and wherein a toner release agent is applied to the surface of said roll, an improved wick assembly for applying said release agent to said roll, comprising:

a wick having a number of layers of cloth material, each layer being adapted to hold said release agent and to engage the surface of said roll;

manually releasable means, distinct from said wick layers, operating to hold said wick layers together so that only the outermost layer may engage the surface of said roll, whereby manual operation of said releasable means allows only the outermost layer to be removed, thereby exposing the adjacent underlayer;

an assembly for holding said wick with its outermost layer in engagement with the surface of said roll; and a supply of toner release agent connected to said wick.

2. The fuser of claim 1 wherein said roll is manually removable, to thereby expose said manually releasable means for manual operation.

3. The fuser of claim 1 including means resiliently biasing said wick against the surface of said roll.

4. The fuser of claim 3 wherein said roll is manually removable, to thereby expose said manually releasable means for manual operation.

5. The fuser of claim 1 wherein said manually releasable means is a manually releasable stitch means.

6. The fuser of claim 4 wherein said manually releasable means is a manually releasable stitch means.

7. The fuser of claim 1 wherein said manually releasable means is a manually releasable stitch means formed of at least two threads for each layer, and coding means associated with and identifying the two-thread stitch means that is associated with each of said layers.

8. The fuser of claim 4 wherein said manually releasable means is a manually releasable stitch means formed of at least two threads for each layer, and coding means associated with and identifying the two-thread stitch means that is associated with each of said layers.

9. The fuser of claim 8 including spring means force biasing said wick against the surface of said roll, to thereby accommodate the reduced thickness of said wick which results from removal of the layers thereof.

10. The fuser of claim 1 wherein said wick is made up of a number of layers of an aramid material.

11. The fuser of claim 4 wherein said wick is made up of a number of layers of an aromatic polyamide material.

12. The fuser of claim 9 wherein said wick is made up of a number of layers of an aromatic polyamide material.

13. The fuser of claim 1 wherein said release agent is a liquid, and including pump means for supplying said liquid to said wick, and control means which is responsive to usage of said fuser connected to control said pump means.

14. A wet release hot roll fuser comprising:

an elongated, heated circular cylinder roll and an elongated, unheated circular cylinder roll in surface engagement, to thereby form a fusing nip through which a sheet of paper bearing unfused toner may be conveyed with the toner thereon in engagement with said heated roll;

an elongated cloth wick assembly in surface engagement with said heated roll, said wick assembly comprising a number of separate individual layers of roll engaging cloth;

manually releasable means which is distinct from said individual cloth layers operating to releasably secure each individual cloth layer to the layer immediately thereunder; and means supplying a toner release medium to said wick assembly.

15. The fuser of claim 14 wherein said individual layers of roll engaging cloth are secured by manually releasable means, and wherein said heated roll is manually removable, to thereby expose said manually releasable means for operation, thereby facilitating removal of the wick assembly's top cloth layer.

16. The fuser of claim 15 wherein said manually releasable means is a manually releasable stitch which holds each cloth layer to its adjacent underlayer.

17. The fuser of claim 16 wherein said release medium is a toner release liquid, and a storage cloth for receiving said release liquid from said supplying means, said storage cloth engaging said wick assembly on the side thereof that is opposite said heated roll.

18. The fuser of claim 17 wherein said wick assembly is manually removable, such that when only the bottom layer thereof remains said wick assembly can be replaced with a new multilayer wick assembly.

19. The fuser of claim 14 including resilient means biasing said wick assembly into engagement with said heated roll.

20. The fuser of claim 15 including spring means force biasing said wick assembly into engagement with said heated roll, to thereby accommodate the reduced wick thickness which results as layers thereof are manually removed.

21. The fuser of claim 16 including resilient means force biasing said wick assembly into engagement with said heated roll, to thereby accommodate the reduced wick thickness as layers thereof are removed.

22. The fuser of claim 14 wherein said cloth wick is made up of an aramid material.

23. The fuser of claim 16 wherein said cloth wick is made up of aromatic polyamide fibers.

24. The fuser of claim 19 wherein said cloth wick is made up of aromatic polyamide fibers.

25. The fuser of claim 17 wherein said release medium is a liquid, and including pump means for supplying said liquid to said wick assembly, and control means which is responsive to usage of said fuser connected to control said pump means, to thereby optimize the quantity of liquid that is supplied to said wick assembly.

26. A pressure roll fuser comprising:

a first and a second elongated circular cylinder roll mounted in pressure contact to thereby form an elongated toner fusing nip;

an elongated and generally U-shaped channel member mounted adjacent to one of said rolls, said U-shaped member having spaced edges which are generally parallel to each other and are located in close proximity to a portion of the surface of said one roll;

a pair of end plates mounted to said U-shaped member so as to generally close the ends thereof;

an elongated, rectangular, multilayer cloth member having a base layer and a number of top layers;

manually releasable means that is distinct from said multilayer cloth operating to secure the layers thereof so that the top layer may be manually removable;

a pair of mounting rods attached to the elongated opposite edges of said base layer;

means removably mounting the ends of said rods to spaced portions of said end plates, so as to cause said base layer to wrap about the spaced edges of said U-shaped member, to thereby close the elongated open portion of said U-shaped member which is adjacent said one roll, thereby placing the top cloth layer of said number of layers which span the space between the spaced edges of said U-shaped member in contact with said portion of said one roll; and a supply of toner release material connected to the closed interior of said U-shaped member so as to generally fill the same.

27. The fuser of claim 26 including resilient means force biasing said U-shaped member into engagement with the adjacent portion of said one roll, to thereby accommodate the reduced cloth thickness as layers are removed.

28. The fuser of claim 27 wherein said cloth is an aromatic polyamide fiber.

29. The fuser of claim 28 wherein said one roll is manually removable, to thereby expose the top cloth layer for manual removal.

30. The fuser of claim 26 wherein said release material is a liquid, and including pump means for supplying said liquid to the closed interior of said U-shaped member, and control means which is responsive to usage of said fuser connected to control said pump means, to thereby supply liquid as a function of said usage.

31. In a pressure fuser having a rotating roll which forms a pressure nip to an adjacent member, wherein a toner image is fused to a substrate as the substrate passes through said fusing nip with the toner thereon engaging the surface of said roll, and wherein a toner release agent is applied to the surface of said roll, an improved wick assembly for applying said release agent to said roll, comprising:

a wick having cloth fiber means adapted to hold said release agent and the outermost portion of said cloth fiber means being adapted to engage the surface of said roll;

manually removable means distinct from and associated with said wick, said manually removable means being constructed and arranged such that manual removal thereof leaves a clean outermost portion of said wick;

an assembly for holding said wick in engagement with the surface of said roll; and a supply of toner release agent connected to said wick.

32. The fuser of claim 31 wherein said cloth fiber means comprises a number of removable layers of cleaning cloth; and said manually removable means comprises manually releasable stitch means enabling removal of the top layer of cloth.

33. The fuser of claim 31 wherein said cloth fiber means comprises a continuous mat of cut, carpet-like fibers; and said manually removable means comprises a number of plastic cleaning layers through which said fibers penetrate, such that manual removal of the top plastic layer over the cut ends of said fibers operates to clean said fibers.

* * * * *